United States Patent [19]

Teeter

[11] Patent Number: 4,515,152

[45] Date of Patent: May 7, 1985

[54] LOAD CENTERING BOOT FOR INVERSE SUSPENSION

[76] Inventor: Roger C. Teeter, 4106 Snag Island Dr., Sumner, Wash. 98390

[21] Appl. No.: 379,106

[22] Filed: May 17, 1982

[51] Int. Cl.[3] ..... A61H 1/02

[52] U.S. Cl. ..... 128/75; 272/144

[58] Field of Search ..... 128/68–71, 128/75, 80 H, 84; 272/144

[56] References Cited

U.S. PATENT DOCUMENTS

| | | | |
|---|---|---|---|
| 2,696,208 | 12/1954 | Falls | 128/84 C |
| 2,723,663 | 11/1955 | Davis | 128/75 |
| 2,952,459 | 9/1960 | Moffitt | 128/80 H |
| 2,969,790 | 1/1961 | Reddig | 128/84 C |
| 2,973,757 | 3/1961 | Katthoefer | 128/80 H |
| 3,380,447 | 4/1968 | Martin | 128/75 |
| 3,875,923 | 4/1975 | Horel | 124/20 R |

*Primary Examiner*—Richard J. Apley
*Assistant Examiner*—David J. Brown
*Attorney, Agent, or Firm*—Morris A. Case

[57] ABSTRACT

A pair of boots each having an outer shell and an inner resilient liner are each contoured to fit at the juncture between a person's foot and leg. The shell and liner of each contoured boot have extended ends that are folded over each other, and secured in the folded position to the person's leg. A support member, attached to the front of the shell, in turn provides for inverted suspension of the person from an independent support member, and a loop attached to the front of the shell extends to contact the back of the person's leg to give torque free suspension to a person wearing the boots.

5 Claims, 16 Drawing Figures

Fig. 1
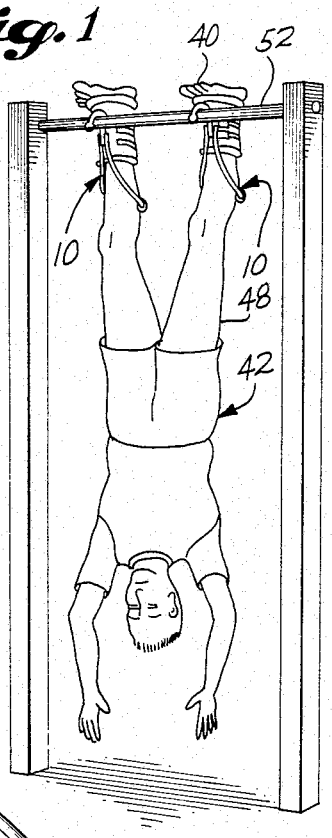
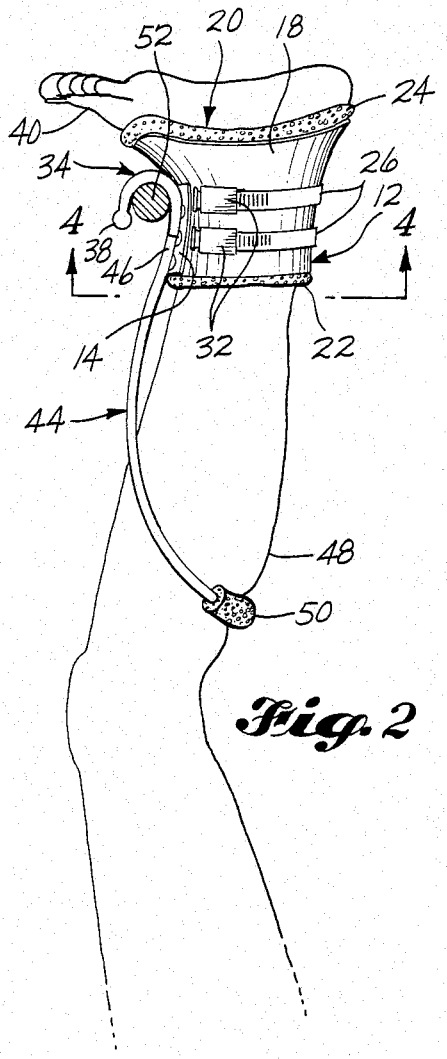
Fig. 2
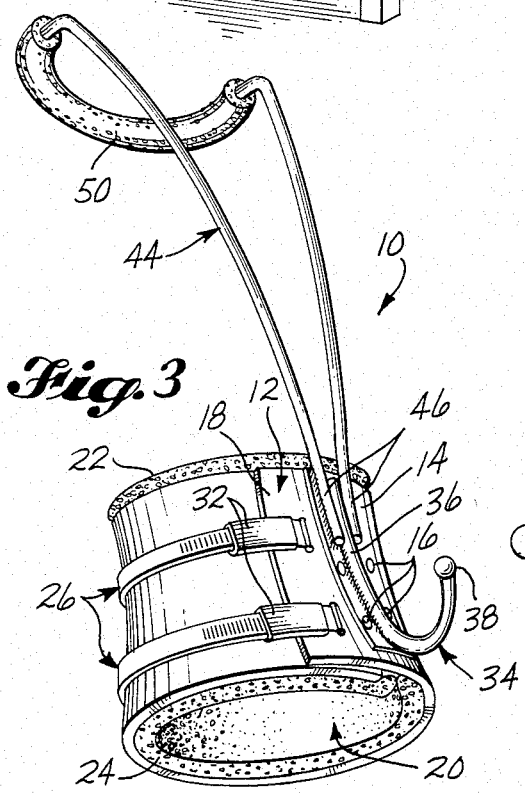
Fig. 3
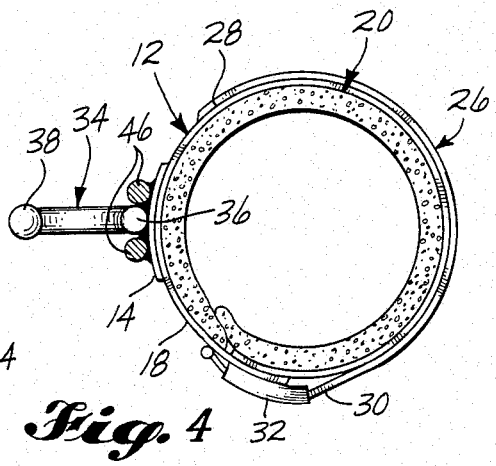
Fig. 4

Fig. 5
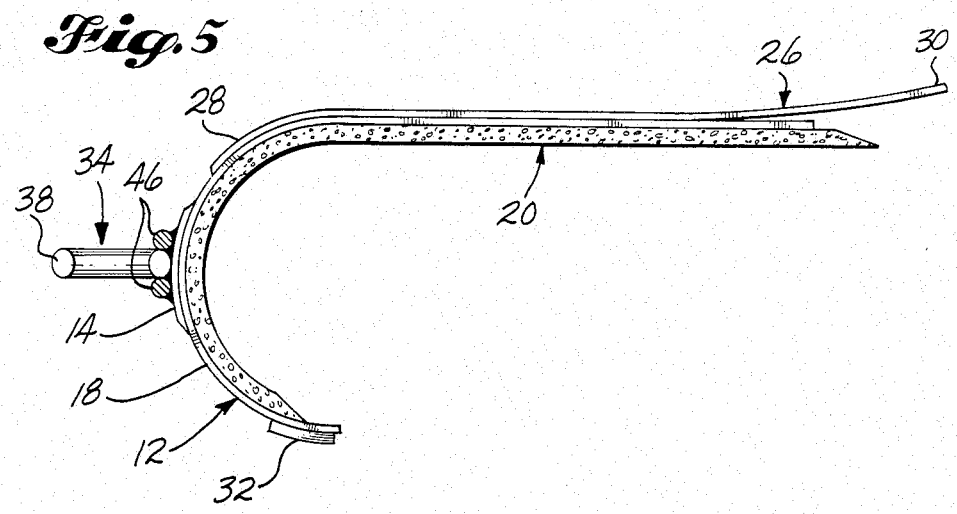
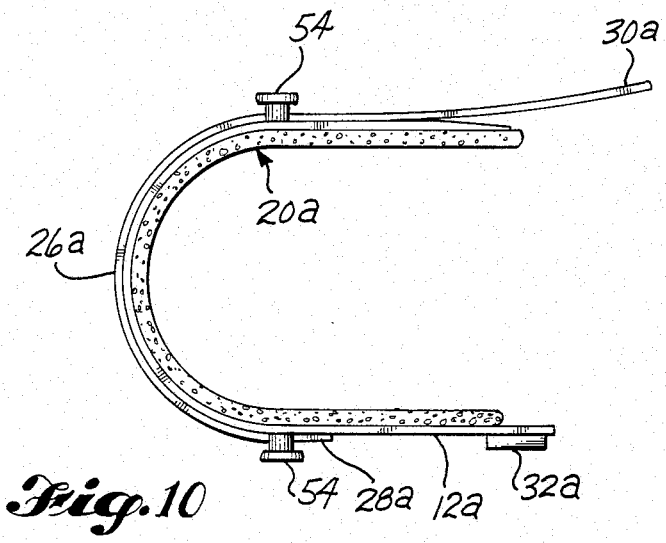
Fig. 10

Fig. 6
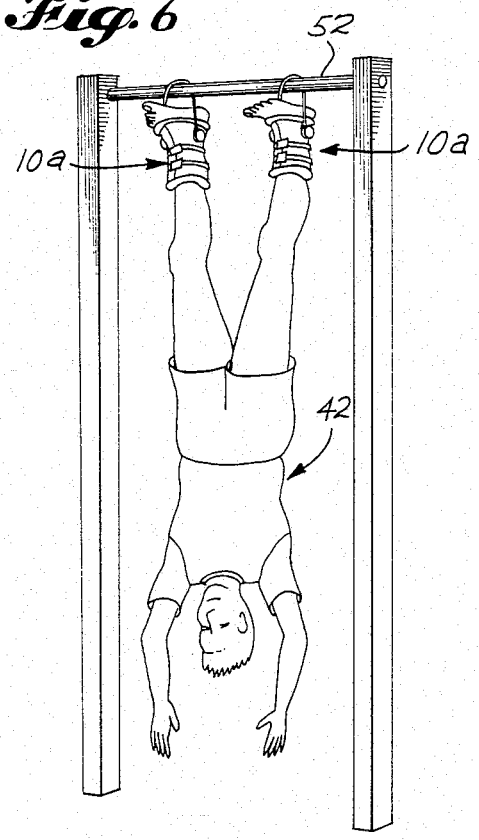
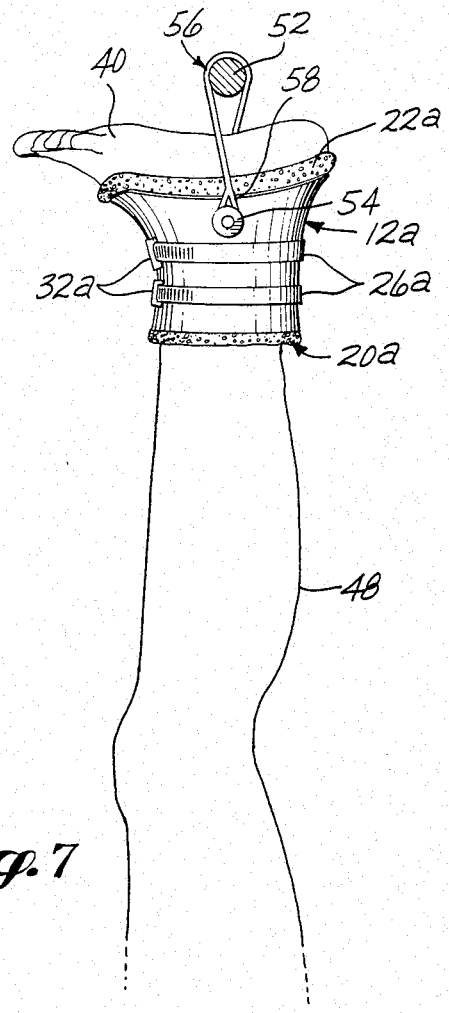
Fig. 7
Fig. 8
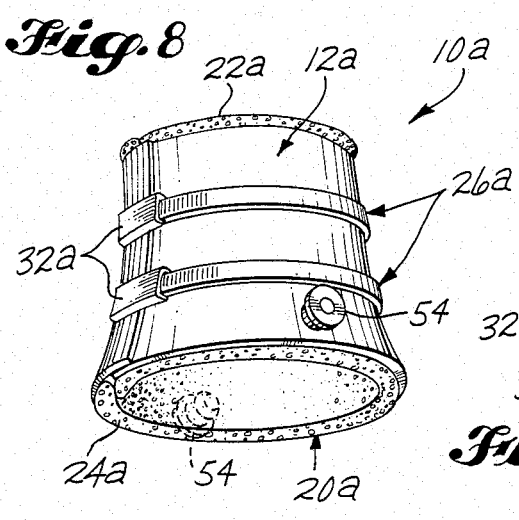
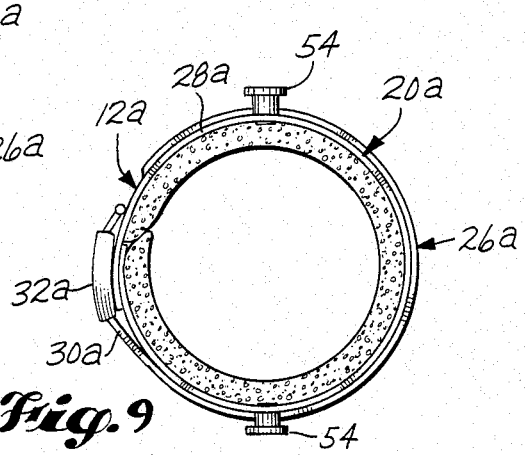
Fig. 9

Fig. 13
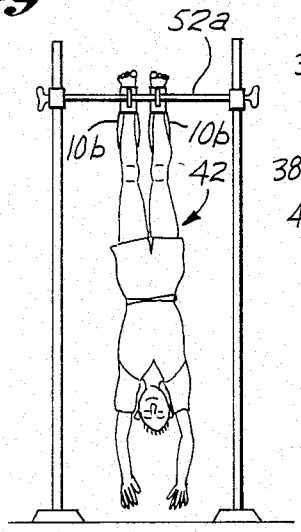
Fig. 11
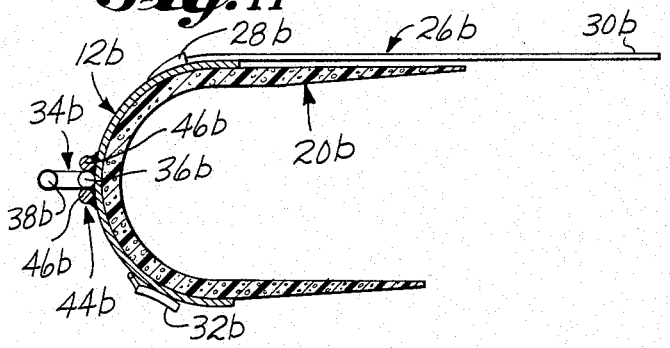
Fig. 12
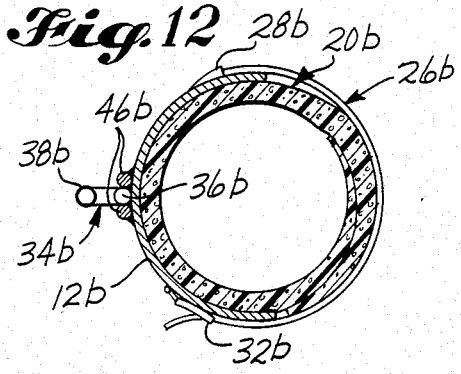
Fig. 16
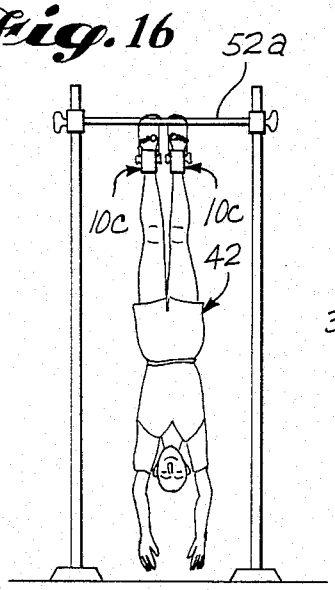
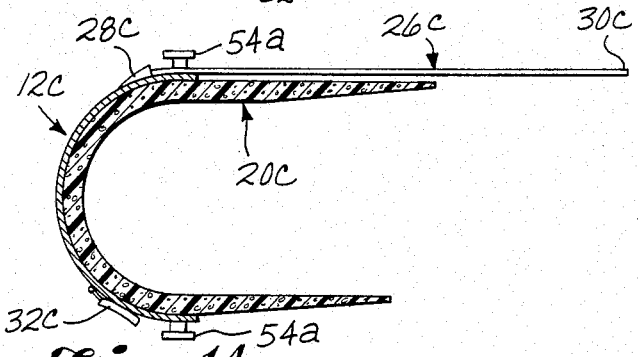
Fig. 14
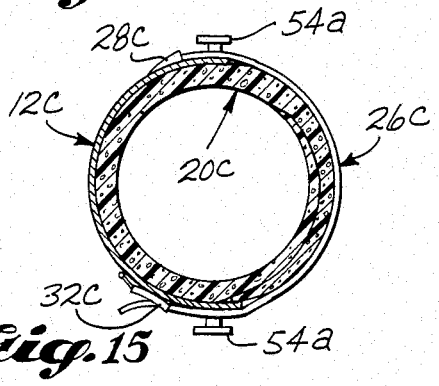
Fig. 15

LOAD CENTERING BOOT FOR INVERSE SUSPENSION

BACKGROUND OF THE INVENTION

It has been found beneficial, in many cases, to suspend persons in an inverted position for a limited period of time. To accomplish this it is known to clamp an ankle device on each leg of a person, to place the ankle devices over a supporting member, and to have the person hang suspended in the inverted position for a period of time. U.S. Pat. No. 3,380,447 covers one such device. It was found that an additional degree of comfort may be imparted to the suspended person if the suspension is accomplished in a manner to prevent a twisting or torque load.

SUMMARY OF THE INVENTION

A boot is contoured to fit at the juncture between a persons foot and leg. An opened contoured boot is inserted onto a person and extensions on the boot are folded over each other, and secured in the folded position to the persons leg. A hook for suspending from a support member is located at the front of the foot, and an adjacently attached loop extends to be contacted by the back of a persons leg.

DESCRIPTION OF THE DRAWINGS

FIG. 1 shows a perspective view of a person suspended in an inverted position while using the boots of this invention.

FIG. 2 shows a side elevational view of this invention attached to a fragmented view of a persons leg.

FIG. 3 shows a perspective view of the boot of this invention.

FIG. 4 shows a cross sectional view taken along lines 4—4 of FIG. 2.

FIG. 5 shows a cross sectional view as in FIG. 4, but with the boot opened prior to placement on a persons leg.

FIG. 6 shows a perspective view of a person suspended in an inverted position while using a different embodiment of this invention.

FIG. 7 shows a side elevational view of the embodiment of FIG. 6 attached to a fragmented view of a persons leg.

FIG. 8 shows a perspective view of the embodiment shown in FIG. 6.

FIG. 9 shows a cross sectional view taken along line 9—9 of FIG. 7.

FIG. 10 shows a cross sectional view as in FIG. 9, but with the boot opened prior to placement on a persons foot.

FIGS. 11 and 12 show cross sectional views similar to FIGS. 4 and 5, but of a different embodiment.

FIG. 13 shows a front view of a person hanging in an inverted position using the embodiment of FIGS. 11 and 12.

FIGS. 14 and 15 show cross sectional views similar to FIGS. 9 and 10, but of a different embodiment.

FIG. 16 shows a front view of a person hanging in an inverted position using the embodiment shown in FIGS. 14 and 15.

DETAILED DESCRIPTION

FIG. 1 shows a person suspended in an inverted position from an overhead support. This is accomplished with the assistance of a load centering boot 10, secured to each leg of the person being suspended. The boot has an outer structural shell 12, made up of a face plate 14; which is secured by fasteners 16 to a sheet 18. The shell is contoured to fit a person at the juncture between the foot and the leg, and when the boot is opened prior to being placed on the leg is U-shaped with the face plate at the bottom of the U. A resilient liner 20 is secured to the inside of the shell and is wider than the shell so that the liner extends above and below the shell at 22 and 24. A pair of straps 26 are each secured at one end to the shell at 28 and the other end 30 extends to be adjustably secured inside a buckle 32; which is secured to the other side of the shell. A U-shaped hook 34, is secured on one of the legs 36, to the face plate, and the other leg terminates in a ball 38 with that leg extending away from the side of the boot that extends toward a foot 40 of a person 42 being suspended. A loop 44, has ends 46, secured to the face plate alongside the hook, and the loop spreads out and extends to contact the back of the persons leg 48. Preferably a soft resilient padding 50 is located on the loop where it contacts the leg.

In use the boot 10, which preferably is preformed so that the shell 12, and resilient liner 20, are normally in the closed position as shown in FIGS. 3 and 4, is placed on a person at the juncture between the foot and leg with the shell face plate 14 located at the front. The shell and liner automatically overlap around the leg, and the end 30 of the straps 26 are inserted into the buckles 32 to secure the boot to the person. Another boot is then secured to the opposite leg, the hooks 34 placed over a bar 52, and the person suspended in the inverted position for treatment. As the hooks are located at the front of the leg and the loop 44 provides support to the back of the legs, the unit makes for a comfortable position as any twisting or torque load is removed.

In a variation of a method of preparing the boot, the shell 12, and resilient liner 20, are not preformed into the folded over position, and in this variation the boot prior to placement on a persons foot takes on a modified U-shape as is shown in FIG. 5. Once this variation is placed on a persons foot the ends of the shell and resilient liner are folded over and the boot secured with the buckles and straps as set out above.

In another embodiment, as is set out in FIGS. 6 through 10, a boot 10*a*, for joining to the juncture of a persons foot and leg has a shell 12*a*, a resilient liner 20*a* secured to the inside of the shell with the liner wider than the shell at 22*a* and 24*a*. A pair of straps 26*a* are joined at one end 28*a* to the shell and the other end 30*a* inserts into a buckle 32*a*. The buckle is joined to the shell. Support means for this boot is furnished by a pair of support pins 54; which are secured to the shell at opposite sides from each other. These support pins are located to be centered with regard to a persons foot.

The boot 10*a* is contoured to fit a person at the juncture between the foot and the leg. The shell and resilient liner of this boot is preferably preformed to fold over and encircle a persons foot; which requires opening before being placed on the person. However, this embodiment may also have the variation in which, prior to installation it takes on an essentually U-shaped as is shown in FIG. 10. As to orientation the boot is preferably shaped with the bottom of the U at the back of the person as shown, however, it is not desired to limit it to this as the boot may be contoured and arranged to have the base of the U at the front of a persons foot. In either case the support pins are centered along opposite side of a persons foot.

In use the boot 10*a* is placed at the juncture between a persons foot 40 and their leg 48. The shell 12*a* and the resilient liner 20*a* respectively have the ends wrapped around each other, and the straps 26*a* inserted in and adjustably joined to buckles 32*a*. The support pins 54 are then used to secure the boots to bar 52; so that the person may be suspended in an inverted position for treatment. For this purpose a strap 56 is used which has a loop 58 on each end. One loop is placed over one of the support pins, the strap placed over the bar 52, and the other end of the loop placed over the other support pin. Both boots are handled in the same way, and the person is then ready to be suspended in an inverted position. It is not desired to limit joining the boot to a bar in this manner as other satisfactory means may be used such as but not limited to a rigid support means, not shown, with a loop over the support pin and a hook on the end to pass over the bar.

FIGS. 11 and 12 show yet another embodiment of a booth 10*b;* which is a variation of the embodiment shown in FIGS. 1 through 5. This boot has a shell 12*b;* which is limited in the length of its legs. The resilient liner 20*b* is secured to the inside of the shell and the ends of the liner are necked down to facilitate folding over each other when the boot is secured. The straps 26*b* are secured at one end 28*b* to the shell, and a buckle 32*b* is located on an opposite side of the shell to accept the end 30*b* of the strap for adjustably fastening the boot ends together. A U-shaped hook 34*b* is secured at end 36*b* to the shelf at the bottom of the U, and ends 46*b* of a loop 44*b* is secured to the shell alongside the leg of the loop. This loop extends to contact the back of the leg of the person being suspended. The resilient liner 20*b* is preferably preformed with folded over legs as shown in FIG. 12. However, it is not desired to limit it to this configuration, and the variation may be used where the boot is essentially U-shaped prior to application as shown in FIG. 11.

FIGS. 14 and 15 show yet another embodiment of a boot 10*c;* which is a variation of the embodiment shown in FIGS. 6 through 10. This boot has a shell 12*c* which is limited in the length of the legs. The resilient liner 20*c* is secured to the inside of the shell and the ends of the liner are necked down to facilitate overlapping over each other when the boot is secured. Straps 26*c* are secured at one end 28*c* to the shell, and buckles 32*c* are located on an opposite side of the shell to accept the ends 30*b* of the straps for adjustably fastening the boot ends together. A pair of support pins 54*a* are secured to the shell. These support pins extend outward across from each other, and are located to be centered on the leg of a person using the boot. The support pins are used for connecting to the bar 52*a*. The resilient liner 20*c* is preferably preformed with folded over legs as shown in FIG. 15. However, it is not desired to limit it to this configuration, and the variation may be used where the boot is essentially U-shaped prior to application, as shown in FIG. 14.

I claim:

1. An inversion boot adapted for attachment to a person's leg for suspending that person in an inverted position wherein said boot comprises: a resiliently lined support member; means for adjustably clamping said support member to a person at the juncture of a person's leg and foot; support means secured to said support member for transferring the person's weight to an independent supporting surface and for centering the load created by a person's weight when in the inverted position; said support means comprising a hook secured to said support member on the front side of said support member and a loop secured to the support member on the front side of said support member wherein the loop extends from alongside the hook, curvilinearly upward so as to engage the back of a person's leg when a boot is clamped onto the foot.

2. An inversion boot adapted for attachment to a person's leg for suspending that person in an inverted position wherein said boot comprises: a preformed resilient shell having normally and automatically closed overlapping ends that may be opened to permit placement on a person at the juncture of said person's foot and leg then to automatically close with said ends overlapping around the leg, a resilient liner secured to the inside of the shell, a buckle secured to an outer surface of the shell, a strap secured at one end to the outer surface of the shell with the other end of the strap extended to permit encircling the overlapping shell and to be adjustably secured in the buckle, and means secured to the shell for transferring the person's weight to an independent support means for suspending the person in an inverted position from the independent support means.

3. An inversion boot adapted for attachment to a person's leg for suspending that person in an inverted position as in claim 2, wherein the means secured to the shell for transferring the person's weight to the independent support means comprises a hook secured to the shell at the front of the leg.

4. An inversion boot for attachment to a person's leg for suspending that person in an inverted position as in claim 3, with the inversion boot further comprising: a loop secured to the shell adjacent the hook with an end of the loop located to press against the back of the suspended person's leg to provide a load centering means.

5. An inversion boot adapted for attachment to a person's leg for suspending that person in an inverted position as in claim 4, with the device further comprising: a resilient material covering the loop at the location on the loop that is contacted by the person's leg.

* * * * *